United States Patent [19]

Etherington et al.

[11] Patent Number: 4,746,170

[45] Date of Patent: May 24, 1988

[54] MINING MACHINERY

[75] Inventors: Michael Etherington, Retford; Hugh Wilson, Worksop, both of United Kingdom

[73] Assignee: Dosco Overseas Engineering Limited, Tuxford, Nr. Newark, United Kingdom

[21] Appl. No.: 825,455

[22] Filed: Feb. 3, 1986

[30] Foreign Application Priority Data

Feb. 20, 1985 [GB] United Kingdom ..... 8504383

[51] Int. Cl.[4] ..... E21C 25/52; E21C 25/66

[52] U.S. Cl. ..... 299/75; 299/26; 299/95

[58] Field of Search ..... 299/73, 75, 76, 78, 299/67, 29, 71, 95

[56] References Cited

U.S. PATENT DOCUMENTS

| | | | |
|---|---|---|---|
| 1,978,367 | 10/1934 | Levin | 299/76 |
| 3,157,438 | 11/1964 | Lundquist | 299/73 |
| 3,929,378 | 12/1975 | Frenyo et al. | 299/76 X |
| 3,998,493 | 12/1976 | Paurat | 299/71 |
| 4,056,189 | 11/1977 | Freed, Jr. | 299/67 X |
| 4,080,000 | 3/1978 | Paurat | 299/71 |
| 4,088,371 | 5/1978 | Le Begue et al. | 299/76 |
| 4,111,488 | 9/1978 | Sigott et al. | 299/75 X |
| 4,362,337 | 12/1982 | Casanova | 299/31 |
| 4,377,311 | 3/1983 | Seller | 299/75 |

FOREIGN PATENT DOCUMENTS

| | | | |
|---|---|---|---|
| 2749042 | 6/1978 | Fed. Rep. of Germany | 299/75 |
| 1434229 | 5/1976 | United Kingdom | 299/76 |

OTHER PUBLICATIONS

AEC "Super Roc-Miner", 7/1978.

*Primary Examiner*—Stephen J. Novosad
*Assistant Examiner*—Bruce M. Kisliuk
*Attorney, Agent, or Firm*—Frost & Jacobs

[57] ABSTRACT

There is provided a continuous mining system comprising at least one chassis, boom arrangement for supporting a continuous miner cutting head, roadheader turntable assembly and, optionally, drilling machine. The latter three items are adapted so that each of them can be removably mounted on any one of the at least one chassis. This enables a continuous mining operation to be carried out without the need to remove the whole of the mining machine if hard rock is encountered.

10 Claims, 3 Drawing Sheets

MINING MACHINERY

The present invention relates to mining machinery and in particular, but not exclusively, to machinery for use in continuously mining coal seams containing hard rock faults.

BACKGROUND OF THE INVENTION

There are two commonly used methods of mechanically mining coal underground. The first of these is generally known as longwall mining, and involves removing substantially all the coal from a seam and allowing the strata above the seam to collapse once the coal has been extracted. This method is suitable for relatively thin seams at relatively large depths, since the effect of allowing the strata to collapse is generally not noticeable on the surface. However, this method is not suitable for thicker seams or seams at smaller depths.

For such seams, the second method, generally known as room-and-pillar mining is suitable. In this method a substantial proportion of the coal in the seam is not removed but is left as pillars surrounded by areas (rooms) from which the coal has been removed. The pillars serve to support the above-lying strata and prevent subsidence occurring at the surface.

Room-and-pillar mining is generally carried out using machines known as continuous miners. A continuous miner generally comprises a movable chassis, for instance mounted on caterpillar tracks.

A pivot mounting is formed integrally on the upper surface of the chassis, for instance as a casting or machined part. A cutting boom extending parallel to the longitudinal axis of the chassis is pivotally mounted on the pivot mounting for movement in a vertical plane by the action of hydraulic rams. The rams are generally connected between the boom and connection points formed integrally on the chassis.

The cutting boom carrier at its free end a generally cylindrical cutting head whose cylindrical axis is arranged horizontally. The cutting head is somewhat wider than the width of the chassis. Common widths for the cutting head are, two, three or four meters. The cutting head is provided with a plurality, for instance about fifty, of cutting picks disposed circumferentially around and extending radially from the cutting head. The cutting head is rotatable about its axis, generally by electric motors and chain drives located on the cutting boom.

A coal clearing means, generally comprising a gathering apron having wing plates at its edges, is provided on the chassis for removing coal cut by the continuous miner from below the cutting head to the rear of the machine. The cut coal is generally forced onto the clearing means by the forward movement of the machine.

In use of the continuous miner, the cutting head is set in rotation, and the machine is moved towards the coal to be cut. As the picks contact the coal, it is ripped out of the seam and falls onto the floor in front of the machine. Once the cutting head has penetrated a given distance into the seam, the boom is pivoted through its fullest possible range to cut out a panel of coal. Thereafter, the machine is again moved towards the coal seam and the operation is repeated. During forward movement of the machine, the cut coal is loaded onto the coal clearing means. Thus, during its operation, the continuous miner forms a tunnel in the coal down which it travels to cut more coal.

A disadvantage of such continuous miners, which has been known for a considerable time, is that they are unable to cut material having a compressive strength of more than about 10,000 psi (68.9 MPa) due to the very large numbers of picks on the head. It is not possible to supply sufficient power to the head to drive this number of picks through material having a compressive strength above the value given above.

Thus, if a continuous miner comes across an area of hard coal, an area in which the coal is interspersed with hard material, or an area of hard material, for instance a rock fault extending through the seam, its progress is halted.

There are generally two methods presently used for enabling the continuous miner to progress beyond the area of hard material. In the first method, the continuous miner is moved backwards until it is entirely out of the tunnel it has created. This may merely entail moving it into a stall created at the side of the tunnel, but may instead entail moving the continuous miner back to a main roadway or the pit bottom. In view of the amount of ancilliary equipment which is set up behind the continuous miner, this operation could take at least 10 shifts to complete.

Once the continuous miner has been removed from the tunnel, a roadheader is moved into the tunnel and used to cut through the area of hard material. Putting the roadheader in place generally takes at least 10 shifts to complete.

Roadheaders are well known in the art and can cut through material having a compressive strength of up to about 30,000 psi (206.8 MPa).

They generally comprise a chassis on which is mounted a turntable assembly including a turntable rotatable in the horizontal plane. The turntable is usually rotatably by use of hydraulic slewing rams connected between the turntable and the chassis. The turntable assembly includes a pivot mounting and a roadheading boom mounted for pivotal movement in a vertical plane on the pivot mounting. The roadheading boom is usually pivoted by means of one or more rams connected between the boom and the pivot mounting. The roadheading boom is arranged to carry a generally conical head having arranged on it in a scroll formation up to about twenty picks. The conical head is rotatable about the longitudinal axis of the boom by means of motors and gearboxes in the boom. Once the area of hard material has been removed and the coal reexposed, the roadheader is removed and the continuous miner is replaced in the tunnel to win the newly exposed coal. The processes of removing the roadheader and replacing the continuous miner generally takes at least ten shifts. There is thus a very large down time involved in this method even without counting the time needed for the roadheader to cut through the area of hard material.

The second method involves the use of drilling and blasting the area of hard material. If the hard material can be drilled by hand-held drills or drills which can be mounted on small tripods or the like, it will only be necessary to move the continuous miner back a safe distance from the area of hard material. It will, in this case, not be necessary to remove the continuous miner from the tunnel.

However, in some cases, it will be necessary to drill the hard material using a drilling machine. In this case it may be necessary to remove the continuous miner from the tunnel and move in a drilling machine, with all the disadvantages in terms of down time referred to above.

Although in many cases it is possible to begin a drilling and blasting operation more quickly than it would be possible to set up a roadheading operation, it is not necessarily quicker to remove the hard material by drilling and blasting. Once set up, a roadheading operation is generally much quicker than a drilling and blasting operation. It may therefore be overall time-effective to use the roadheading operation.

Moreover, in some cases, it may be environmentally unacceptable to use a drilling and blasting operation, for instance if the mining operation is being carried out under or near a community or an area which is particularly susceptible to seismic shocks. In such cases it will be necessary to carry out a roadheading operation.

Although this disadvantage of having a large amount of unproductive time during a room-and-piller mining operation when an area of hard material is encountered has been known for a considerable time, no proposals for overcoming this disadvantage have been made.

It is an aim of the present invention to provide a solution to the problem set out above.

SUMMARY OF THE INVENTION

According to a first aspect of the present invention, there is provided a boom arrangement for a continuous miner comprising:

a pivot mounting which is removably mountable on a chassis; and a cutting boom, pivotally mounted on and movable in a vertical plane about the pivot mounting, for carrying thereon a rotatable cylindrical cutting head with its axis arranged horizontally.

According to a second aspect of the present invention, there is provided a chassis for a convertible continuous miner, the chassis being adapted to receive either a boom arrangement according to the first aspect of the invention or a roadheader turntable assembly.

Preferably, the chassis is also adapted to receive thereon, in place of the boom arrangement or the turntable assembly, a drilling machine.

According to the third aspect of the present invention, there is provided a continuous mining system comprising:

at least one chassis according to the second aspect of the invention;

at least one boom arrangement according to the first aspect of the inventon adapted to be removably mounted on any one of said at least one chassis;

at least one roadheader turntable assembly adapted to be removably mounted on any one of said at least one chassis; and optionally, at least one drilling machine adapted to be removably mounted on any one of said at least one chassis.

Preferably, the system comprises an equal number of chassis and boom arrangements and only one each of the roadheader turntable assembly and the drilling machine.

Conveniently, the cutting boom will have the cylindrical cutting head rotatably mounted thereon with its axis arranged horizontally and will also comprise the necessary motors, gear-boxes and/or drive chains for causing the cutting head to rotate. Similarly, the roadheader boom will also conveniently have a conical cutting head mounted thereon for rotation about the longitudinal axis of the roadheader boom, and will comprise the necessary motors and gear boxes for effecting such rotation. However, as is known in the art, these parts are preferably supplied as modular items which are installed on the machinery at its site of operation.

Preferably, each chassis has on its top surface a plurality of threaded holes, advantageously equally spaced apart around a circular path, for receiving in screw fashion a complementary number of bolts. In this case, the boom arrangmemnt pivot mounting, the roadheader turntable and the drilling machine will each comprise an appropriately shaped, advantageously circular, flange having a complementarily arranged set of holes for receiving therethrough in sliding fashion the shanks of the bolts, whereby whichever piece of machinery is to be used, it can be securely bolted on to the chassis.

Advantageously, the cutting boom is pivotable by means of at least one ram. Preferably the or each ram is connected between the boom and the pivot mounting. However, alternatively, the or each ram may be connected between the boom and a lug provided on the chassis. This latter arrangement is less preferred as it is necessary to ensure that the lugs do not interfere with the rotation of the roadheader turntable when it is fitted.

Preferably, the axis of the pivot in the boom arrangement is located below the level at which the pivot mounting is attached to the chassis. This arrangement will enable the machinery when arranged to operate as a continuous miner to operate in relatively narrow seams. However, this arrangement need not be adopted if the seam is relatively wide.

Advantageously, the roadheader turntable assembly is rotatable by use of slewing rams, in which case it will be necessary to provide on the chassis a mounting means for each of the slewing rams. Again, it will be necessary to ensure that these mounting means are located so that they do not interfere with the operation of the boom arrangement.

Preferably, all the rams for pivotting or slewing are hydraulically operated. For use with the boom arrangement, one set of hydraulic connections will be shut off, but these will be opened for use with the roadheader turntable assembly to operate the slewing rams.

Advantageously, the chassis includes a gathering apron having removable wing plates. The wing plates will be retained in place for use with the boom arrangement, so that the cut coal can be efficiently cleared, but will be removed for use with the roadheader turntable assembly so as not to interfere with movement of the roadheader boom.

It will be readily apparent that the system of the present invention will to a large extent overcome the problem set out above. In normal use, the chassis will have mounted on it the boom arrangement, and will therefore be able to act as a continuous miner. When an area of hard material is encountered, the boom arrangement can be removed and either a roadheader turntable assembly or a drilling machine can be mounted on the chassis in place of the boom arrangement. It is envisaged that this change over could be accomplished in about 3 or 4 shifts.

It is to noted that, in general, the mine operator will be aware in advance that an area of hard material will be encountered, and therefore the roadheader turntable assembly or the drilling machine can be sent to the appropriate area in advance, while the system is still being used as a continuous miner, again saving on down time.

Once the area of hard material has been removed, the system can again be set out as a continuous miner and the roadheader turntable assembly or drilling machine can be used at another location or returned to storage until needed later.

An additional advantage of this system is that it reduces the capital cost of the operation, in that it eliminates the necessity for buying a number of continuous miners, at least one roadleader and at least one drilling machine.

DESCRIPTION OF THE DRAWINGS

One embodiment of a continuous mining system according to the present invention is described below with reference to the accompanying drawings, in which:

FIG. 8 is a fragmentary side view of the system arranged to operate as a drilling machine.

FIG. 9 is a fragmentary plan view of the system of FIG. 8.

DESCRIPTION OF THE PREFERRED EMBODIMENTS

Figure 1:
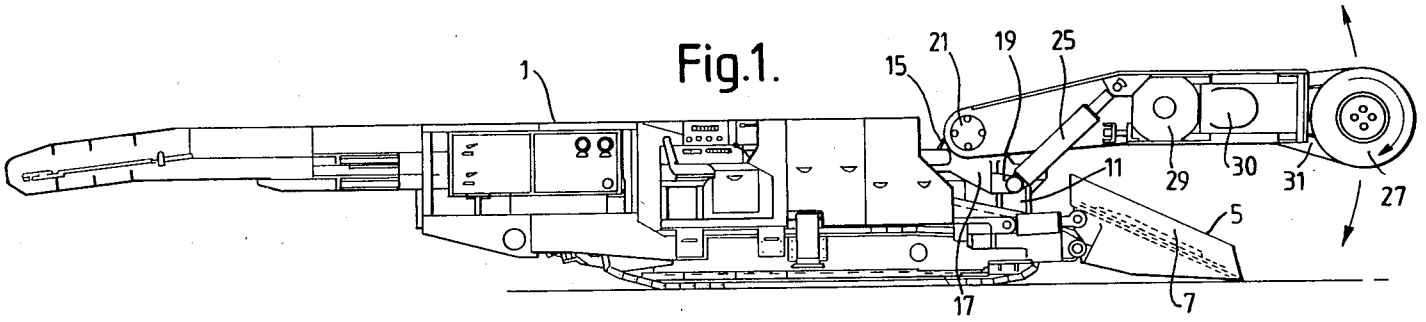
FIG. 1 is a side view of the system arranged to operate as a continuous miner.
Figure 2:
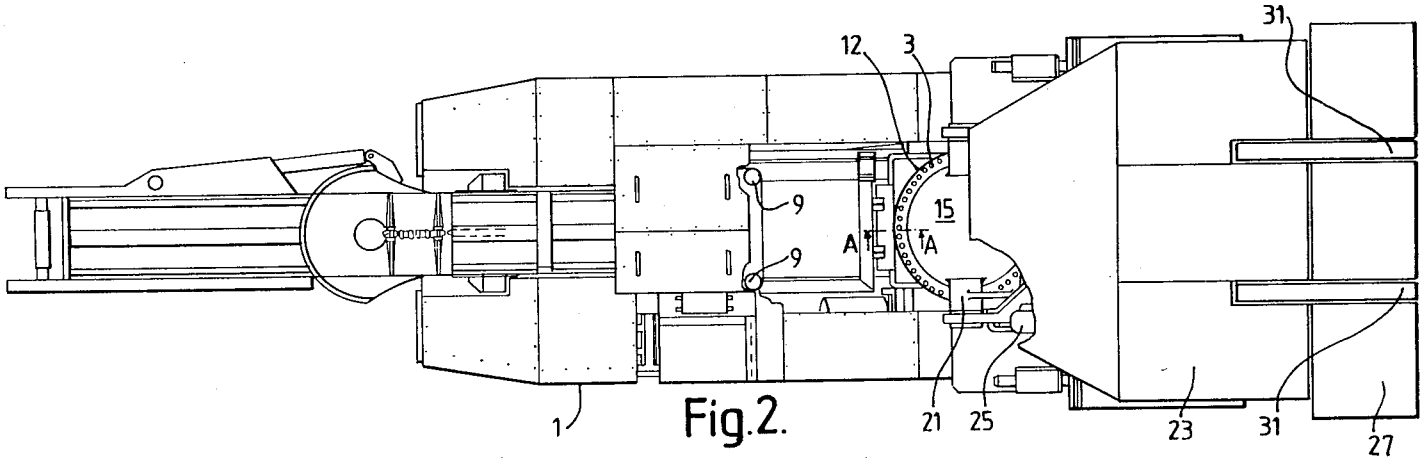
FIG. 2 is a plan view of the system of FIG. 1.
Figure 3:
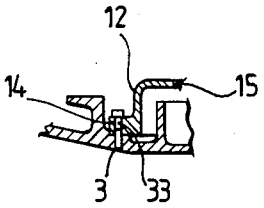
FIG. 3 is a view along line A—A of FIG. 2.

Referring now to FIGS. 1 to 3 there is shown a chassis 1 which in general is similar to such a chassis forming part of a conventional continuous miner. However, instead of having a pivot mounting formed integrally on its upper surface, the chassis 1 is provided with a plurality of threaded holes 3 arranged on a circular path in its upper surface. Also the chassis 1 has no lugs or other means on it for connection to pivotting rams, but is provided with mounting means 9 for connection to slewing rams.

The chassis 1 has at its front a gathering apron 5 which is also generally of conventional design. However, in contrast to a normal gathering apron on a conventional continuous miner, the apron 5 has wings 7 removably attached thereto.

The chassis 1 is adapted to receive a separate pivot mounting 11 which comprises an annular flange 12. The flange 12 has in it a number of clearance bolt holes 14 which are complementary to the threaded holes 3 on the chassis 1.

The pivot mounting 11 also comprises a bearing support 15 and a depending skirt 17. Two pivotting ram connection lugs 19 are provided on the depending skirt 17.

A bearing 21 is carried in the bearing support 15 and a cutting boom 23 is fixed onto the free ends of the bearing 21. A pivotting ram 25 is connected to each side of the cutting boom 23 and each ram 25 is connected to its respective lug 19 on the depending skirt 17. The rams 25 operate to pivot the cutting boom 23 in a vertical plane about the bearing 21.

A conventional cylindrical cutting head 27 is rotatably mounted on the cutting boom 23 with its axis horizontal. The cutting boom 23 contains conventional motors 29 and the assembly is provided with conventional gear boxes 30 and chain drive equipment 31 for causing the cutting head 27 to rotate.

In use, the boom arrangement is removably secured to the chassis 1 by means of bolts 33 passing through the clearance holes 14 and screwed into the threaded holes 3 in the chassis. The only other connections which need to be made are electrical connections for the motors 29 and hydraulic connections for the pivotting rams 25. The machine comprising the boom arrangment removably mounted on the chassis 1 can be used in exactly the same fashion as is a conventional continuous miner.

If an area of hard material is encountered, the machine can be converted to act as a roadheader. To achieve this, hydraulic and electrical connections are uncoupled, the cutting head 27, motors 29 and chain drive equipment 31 are dismantled and, if desired, the rams 25 are disconnected and the cutting boom 23 is dismounted. These items may then be removed to the rear of the chassis 1 as modules. Also the wings 7 on the apron 5 are removed. Finally the bolts 33 are unscrewed and the pivot mounting 11 is removed from the chassis 1.

Alternatively, if suitable lifting gear can be made available, the whole boom arrangement including the pivot mounting 11, the boom 23 and the cutting heat 27 can be removed by merely disconnecting the electrical and hydraulic supply lines and undoing the bolts 33. This will considerably reduce the change-over time.

Figure 6:
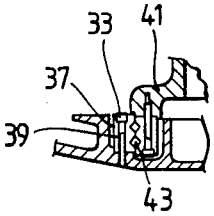
FIG. 6 is a view along line B—B of FIG. 5.
Figure 7:
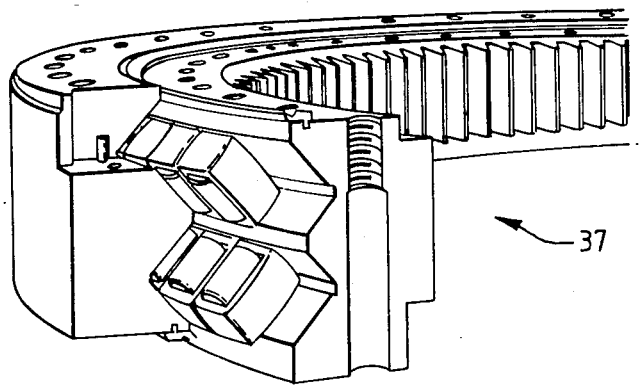
FIG. 7 is a partly cut-away perspective view of the slewing ring bearing unit of FIGS. 4 and 5 with parts removed for the sake of clarity.
Figure 4:
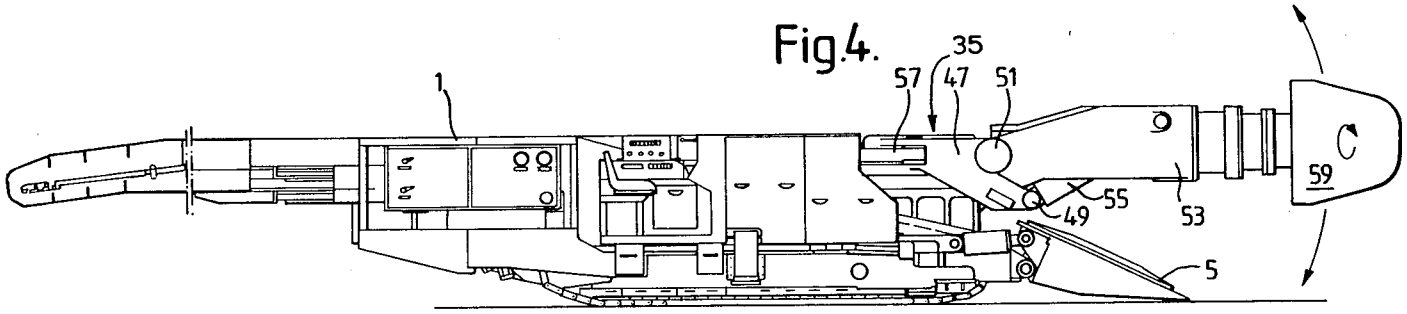
FIG. 4 is a side view of the system arranged to operate as a roadheader.
Figure 5:
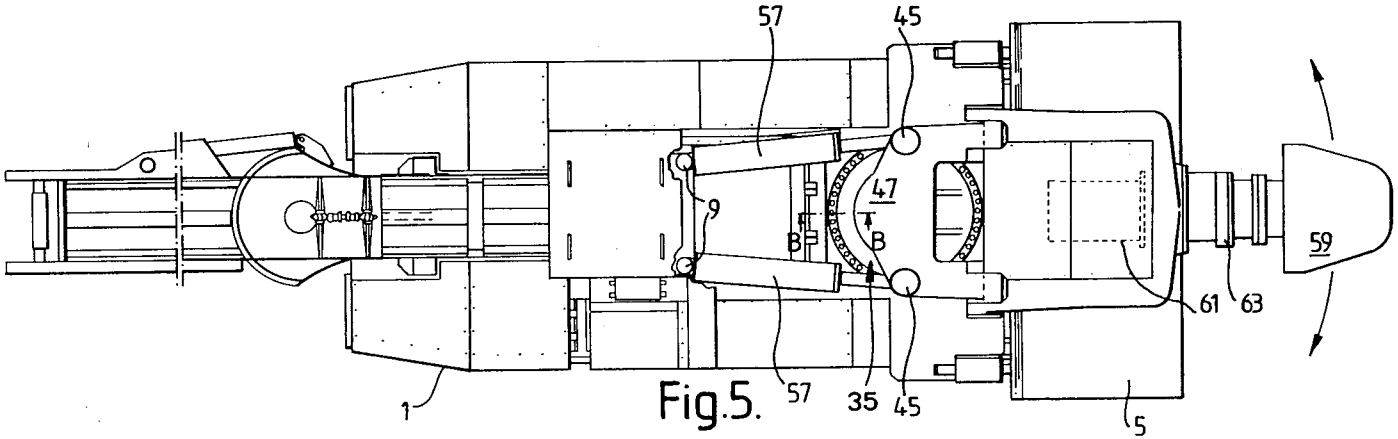
FIG. 5 is a plan view of the system of FIG. 4.

A roadheader turntable assembly 35 is then fixed onto the chassis 1. This assembly 35 is shown in FIGS. 4 to 6, and comprises a slewing bearing unit 37 which is illustrated in FIG. 7, to which reference is also made. The slewing unit 37 has in it a number of clearance bolt holes 39 which are complementary to the threaded holes 3 on the chassis 1. The assembly 35 also comprises a turntable 41 rotatably mounted on ring bearing 43 inside the flange 37. The turntable 41 also has on it slewing rams brackets 45.

The turntable 41 also comprises a bearing support 47 and pivotting ram lugs 49. A bearing 51 is carried in the bearing support 47 and a roadheader boom 53 is fixed onto the free end of the bearing 51. a pivotting ram 55 is connected to each side of the roadheader boom 53 and each ram 55 is connected to its respective lug 49 on the turntable 41. A slewing ram 57 is connected between each bracket 45 and a lug 9 on the chassis 1.

A conventional conical head 59 is mounted on the roadheader boom 53 for rotation about the longitudinal axis thereof. The roadheader boom 53 also contains conventional motor 61 and gearboxes 63 for effecting rotation of the conical head 59.

In use, the turntable assembly is removably secured to the chassis 1 by means of the bolts 33 passing through the clearance holes 39 and screwed into the threaded holes 3. The free ends of the slewing rams 57 are connected to their respective mounting means 9 and are connected to a hydraulic power supply (not shown). The pivotting rams 55 and the electric motor 61 are also connected to suitable power supplies (not shown). The machine comprising the turntable assembly 35 removably mounted on the chassis 1 can be used in exactly the same fashion as is a conventional roadheader.

Once the area of hard material has been cut through, the machine can be converted back again to operate as a continuous miner.

It will be readily appreciated that a drilling machine can also be removably mounted on the chassis 1 so long as it is also provided with the necessary annular flange having therein smooth bolt holes. As seen in FIGS. 8 and 9, a drilling machine 62 is mounted on the chassis 1 utilizing a pivot mounting 11a having an annular flange 12*a* with clearance bolt holes 14*a* complementary to the threaded holes 3 on the chassis 1. Thus, the machine can be converted to carry out any one of three functions.

The embodiments described above are given by way of example only, and it will be readily apparent to those skilled in the art that modifications and variations may be made without departing from the scope of the present invention.

What we claim is:

1. A mining machine for mining mineral seams containing minerals of different hardness, said machine comprising a chassis having thereon mounting means for mounting different mining attachments on said machine, said mounting means comprising support means having a plurality of securing means by means of which each of said attachments may be supported on and secured to said machine, and wherein one of said attachments comprises a continuous miner, said continuous miner including a pivot mounting having a pivot axis, said pivot mounting being complementary with said support means and having pivot mounting securing means which are complementary with said securing means on said support means to enable said pivot mounting to be secured to said support means, and a cutting boom, pivotally mounted on and movable in a vertical plane about the pivot axis of the pivot mounting, the cutting boom carrying thereon a rotatable cylindrical continuous miner cutter head with the axis of said cutter head arranged horizontally, and wherein another of said mining attachments comprises a roadheader turntable assembly, said roadheader turntable assembly comprising a slewing unit which is complementary with said support means and has slewing unit securing means which are complementary with said securing means on said support means to enable said slewing unit to be secured to said support means, and a turntable rotatably mounted on said slewing unit about a vertical axis, said turntable having a bearing support thereon, and a roadheader boom mounted on said bearing support, with a cutter head on its free end, the arrangement being such that the pivot mounting and the turntable assembly are removably mountable on the mounting means and interchangeable, whereby the machine can alternatively be used as a continuous miner or a roadheader for mining said mineral of different hardness.

2. The machine of claim 1 wherein the mounting means comprises a circular support means, wherein said plurality of securing means comprise a plurality of threaded holes in the upper surface of said circular support means adapted to receive the shanks of a complementary plurality of bolts, and wherein said turntable assembly and said pivot mounting each includes a circular flange complementary with said circular support means and having therein a set of holes, arranged to be complementary with the plurality of threaded holes on the circular support means, for receiving therethrough in sliding fashion the shanks of the bolts.

3. The machine of claim 2 wherein each plurality of holes and each set of holes are arranged about a circular path.

4. The machine of claim 1 and further including a gathering apron having removable wing plates.

5. A mining machine for mining mineral seams containing minerals of different hardness, said machine comprising a chassis having thereon mounting means for mounting different mining attachment on said machine, said mounting means comprising support means having a plurality of securing means by means of which each of said attachments may be supported on and secured to said machine, and wherein one of said attachments comprises a continuous miner, said continuous miner including a pivot mounting having a pivot axis, said pivot mounting being complementary with said support means and having pivot mounting securing emans which are complementary with said securing means on said support means to enable said pivot mounting to be bolted to said support means, and a cutting boom, pivotally mounted on and movable in a vertical plane about the pivot axis of the pivot mounting, the cutting boom carrying thereon a rotatable cylindrical continuous miner cutter head with the axis of said cutter head arranged horizontally, and wherein another of said mining attachments comprises a drilling machine having mounting means which is complementary with said support means and has drilling machine securing means which are complementary with said securing means on said support means to enable said drilling machine to be secured to said support means, the arrangement being such that the pivot mounting and the drilling machine are removably mountable on the mounting means and interchangeable, whereby the machine can be alternatively used as a continuous miner or for drilling holes to receive explosives.

6. A mining machine according to claim 5 wherein the mounting means comprises a circular support means, wherein said securing means of said mounting means comprise a plurality of holes in the upper surface of said circular support means adapted to receive bolts, and wherein complementary bolt holes are provided in the mounting means of the drilling machine and in the pivot mounting.

7. A mining machine for mining mineral seams containing minerals of different hardness, said machine comprising a chassis having thereon mounting means for mounting different mining attachments on said machine, said mounting means comprising support means having a plurality of securing means by means of which each of said attachments may be supported on and secured to said machine, and wherein one of said attachments comprises a roadheader turntable assembly, said roadheader turntable assembly comprising a slewing unit which is complementary with said support means and has securing means which are complementary with said securing means on said support means to enable said slewing unit to be bolted to said support means, and a turntable rotataly mounted on said slewing unit about a vertical axis, said turntable having a bearing support thereon, and a roadheader boom mounted on said bearing support, with a cutter head on its free end, and wherein another of said mining attachments comprises a drilling machine having mounting means which is complementary to said support means and has securing means which are complementary with said securing means on said support means to enable said drilling machine to be secured to said support means, the arrangement being such that the turntable assembly and the drilling machine are removably mountable on the mounting means and interchangeable, whereby the machine can be alternatively used as a roadheader or for drilling holes to receive explosives.

8. A mining machine according to claim 7 wherein the mounting means on said chassis comprises a circular support means, wherein said securing means comprise a plurality of holes in the upper surface of said circular support means adapted to receive bolts, and wherein complementary bolt holes are provided in the mounting means of the drilling machine and in the slewing unit.

9. A mining machine for mining mineral seams containing minerals of different hardness, said machine comprising a chassis having thereon mounting means for mounting different mining attachments on said machine, said mounting means comprising support means having a plurality of securing means by means of which each of said attachments maya be supported on and secured to said machine, and wherein one of said attachments comprises a continuous miner, said continuous miner including a pivot mounting having a pivot axis, said pivot mounting being complementary with said support means and having pivot mounting securing means which are complementary with said securing means on said support means to enable said pivot mounting to be secured to said support means, and a cutting boom, pivotally mounted on and movable in a vertical plane about the pivot axis of the pivot mounting, the cutting boom carrying thereon a rotatable cylindrical continuous miner cutter head with the axis of said cutter head arranged horizontally, and wherein another of said mining attachments comprises a roadheader turntable assembly, said roadheader turntable assembly comprising a slewing unit which is complementary with said support means and has securing means therein which are complementary with said securing means on said support means to enable said slewing unit to be secured to said support means, and a turntable rotatably mounted on said slewing unit about a vertical axis, said turntable having a bearing support thereon, and a roadheader boom mountd on said bearing support, with a cutter head on its free end, and wherein another of said mining attachments comprises a drilling machine having mounting means which is complementary with said support means and has securing means which are complementary with said securing means on said support means to enable said drilling machine to be secured to said support means, the arrangement being such that the turntable assembly, pivot mounting and the drilling machine are removably mountable on the mounting means and interchangeable, whereby the machine can alternatively be used as a continuous miner, a roadheader or for drilling holes to receive explosives.

10. A mining machine according to claim 9 wherein the mounting means comprises circular support means, wherein said securing means on said mounting means comprise a plurality of holes in the upper surface of said circular support means adapted to receive bolts, and wherein said turntable assembly and said pivot mounting each includes a complementary circular flange having therein a set of holes arranged to be complementary with the plurality of holes in the circular support means, and wherein the drilling machine is also provided with mounting means having complementary bolt holes therein, the complementary holes being arranged to receive therethrough bolts for selectively connecting one of said pivot mounting, turntable assembly and drilling machine to said mounting means on the machine.

* * * * *